US005511471A

United States Patent [19]

Foote

[11] Patent Number: 5,511,471

[45] Date of Patent: Apr. 30, 1996

[54] CAR MAT PRESSER DEVICE

[76] Inventor: Jonathan P. Foote, 3111 Harview Ave., Baltimore, Md. 21234

[21] Appl. No.: 419,432

[22] Filed: Apr. 10, 1995

[51] Int. Cl.[6] ..... B30B 3/04

[52] U.S. Cl. ..... 100/161; 15/262; 100/121; 100/172

[58] Field of Search ..... 100/121, 161, 100/172, 176; 15/40, 102, 262; 68/235 D, 244, 247, 248, 274; 99/349, 574, 585, 621

[56] References Cited

U.S. PATENT DOCUMENTS

| | | | |
|---|---|---|---|
| 241,119 | 5/1881 | Boomer | 100/161 |
| 4,324,325 | 4/1982 | Dewoolfson | 100/176 |
| 4,703,537 | 11/1987 | Yamamoto et al. | 15/102 |
| 5,349,901 | 9/1994 | Brittain et al. | 100/121 |

FOREIGN PATENT DOCUMENTS

| | | | |
|---|---|---|---|
| 422699 | 7/1948 | Italy | 100/121 |
| 463676 | 11/1951 | Italy | 100/172 |
| 465408 | 5/1952 | Italy | 100/121 |
| 72422 | 8/1931 | Sweden | 68/244 |
| 1183202 | 10/1985 | U.S.S.R. | 15/102 |

*Primary Examiner*—Stephen F. Gerrity

[57] ABSTRACT

The car mat presser device of the invention includes a unitary housing having a plurality of pairs of cooperating rolls, with each of the rolls defining a nip therebetween, wherein an entrance slot directed into the housing is oriented in alignment with the nip of each pair of rolls, with an exit opening directed through a bottom wall of the housing to receive a car mat therethrough subsequent to its projection through the roller pairs.

4 Claims, 3 Drawing Sheets

CAR MAT PRESSER DEVICE

TECHNICAL FIELD

The field of invention relates to web water extraction structure, and more specifically to a car mat presser device permitting an individual an opportunity to extract water relative to vehicular mats prior to their replacement within an associated vehicle.

BACKGROUND OF THE INVENTION

Typically in the cleaning of interior surfaces of a vehicle, car mats of a web construction are washed and must be subsequently hung for an extended period of time to effect their drying. The instant invention is addressed to expediting and minimizing a drying time by extracting excess water from a car mat member.

SUMMARY OF THE INVENTION

The car mat presser device of the invention includes a unitary housing having a plurality of pairs of cooperating rolls, with each of the rolls defining a nip therebetween, wherein an entrance slot directed into the housing is oriented in alignment with the nip of each pair of rolls, with an exit opening directed through a bottom wall of the housing to receive a car mat therethrough subsequent to its projection through the roller pairs.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
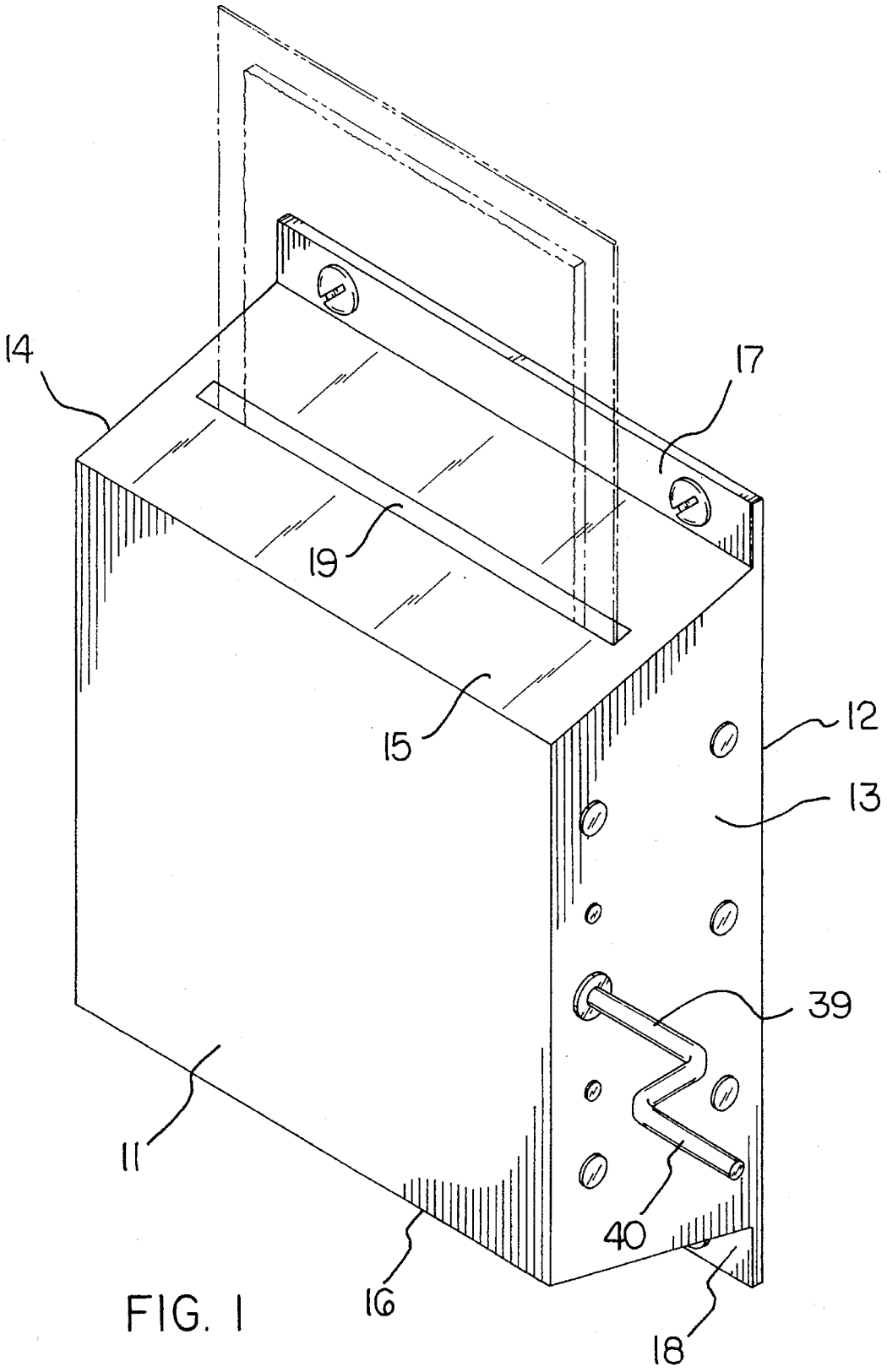
FIG. 1 is a perspective illustration of the invention.
Figure 2:
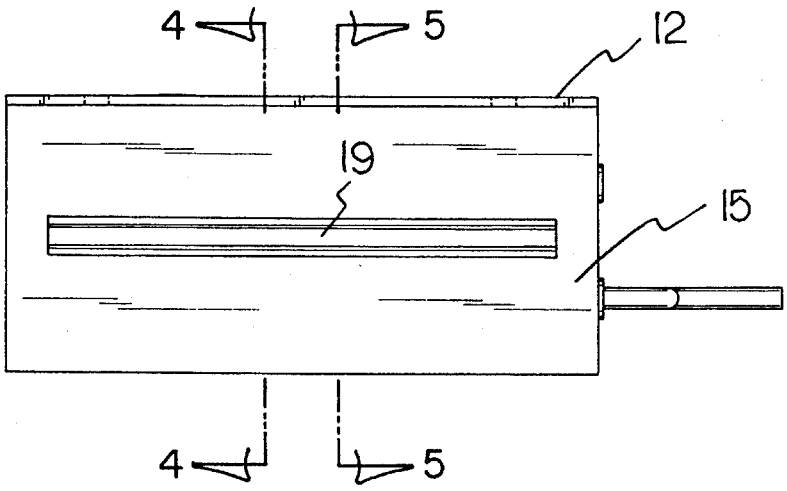
FIG. 2 is a top plan view of the invention.

The car mat presser device 10, as indicated in FIG. 1, comprises a housing of generally unitary construction, having a front wall 11 spaced from a rear wall 12, a first side wall 13 spaced from a second side wall 14, and a top wall 15 spaced from a bottom wall 16. A plurality of pairs of rollers are oriented, namely indicated as respective first, second, and third roller pairs, in a manner as indicated in the FIGS. 4 and 5 for example. It should be noted that each of the roller pairs define a nip in the cooperation of each roller of each respective roller pair in cooperation relative to one another, and it is through this nip by which a car mat, such as indicated in phantom in FIG. 1, is directed in a pressing procedure to extract water therefrom subsequent to washing of such a mat member.

The housing's rear wall 12 has as an extension thereof an upper mounting flange 17 extending above or beyond the top wall 15, as well as a lower mounting flange 18 extending below the bottom wall 16, such as the upper and lower mounting flanges 17 and 18 are substantially aligned relative to one another in a typically coplanar relationship relative to the rear wall, with each having a plurality of bores or the like to accommodate various fasteners for attachment of the housing structure in a vertical orientation as indicated relative to a wall surface and the like.

The top wall 15 is provided with an elongate top wall entrance slot 19, with the bottom wall 16 having a bottom wall exit slot 20. The entrance and exit slots 19 and 20 are substantially aligned relative to one another. The roller pairs define respective first, second, and third roller pairs, wherein a first and second roller 21 and 22 respectively define a first roller pair, a third and fourth roller 23 and 24 define a second roller pair, and a fifth and sixth roller 25 and 26 define a third roller pair. Each of the rollers, as illustrated, are mounted upon an individual roller axle to rotatably mount the rollers between the first and second side walls 13 and 14, in a manner such as exemplified by FIG. 3 for example. Further, each of the roller pairs define a nip defined by a first, second, and third nip 43, 44, and 45, with the nips arranged in a parallel and coextensive relationship relative to one another and aligned relative to one another, as well as to the entrance and exit slots 19 and 20, in a manner as indicated in the FIGS. 4 and 5.

Figure 3:
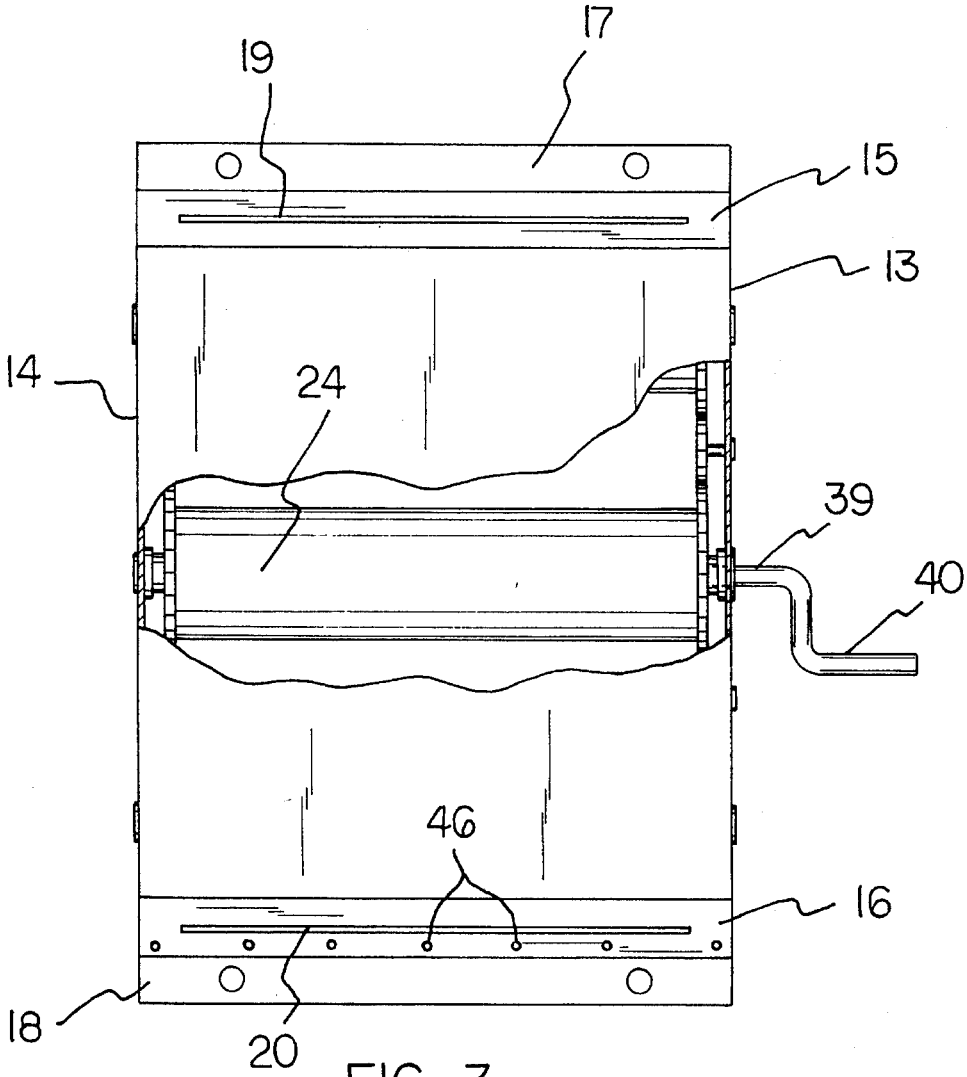
FIG. 3 is a front view, taken in elevation, of the invention with a partial removal of the front wall of the housing.
Figure 4:
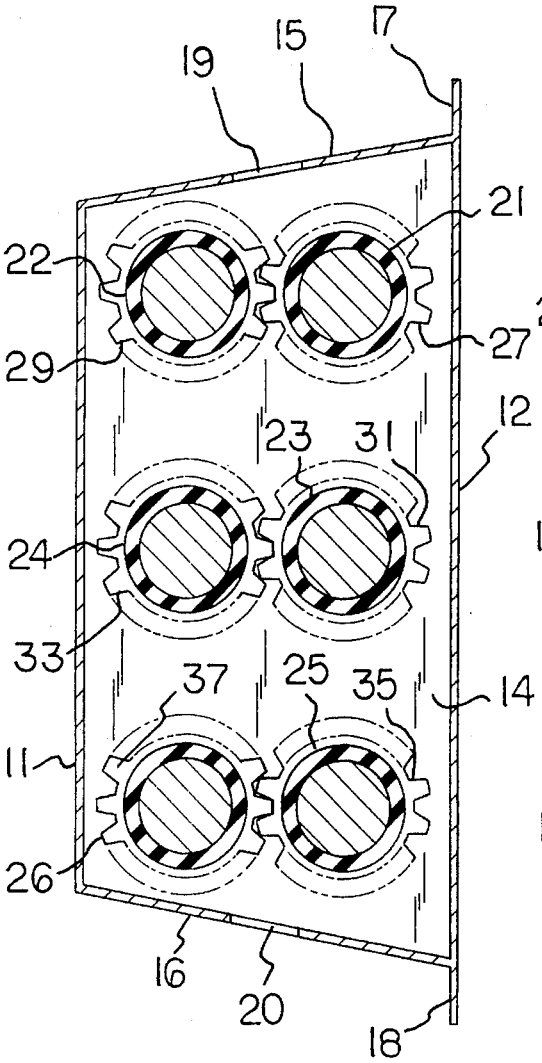
FIG. 4 is a cross-sectional view, taken along the lines 4—4 as indicated in FIG. 2.
Figure 5:
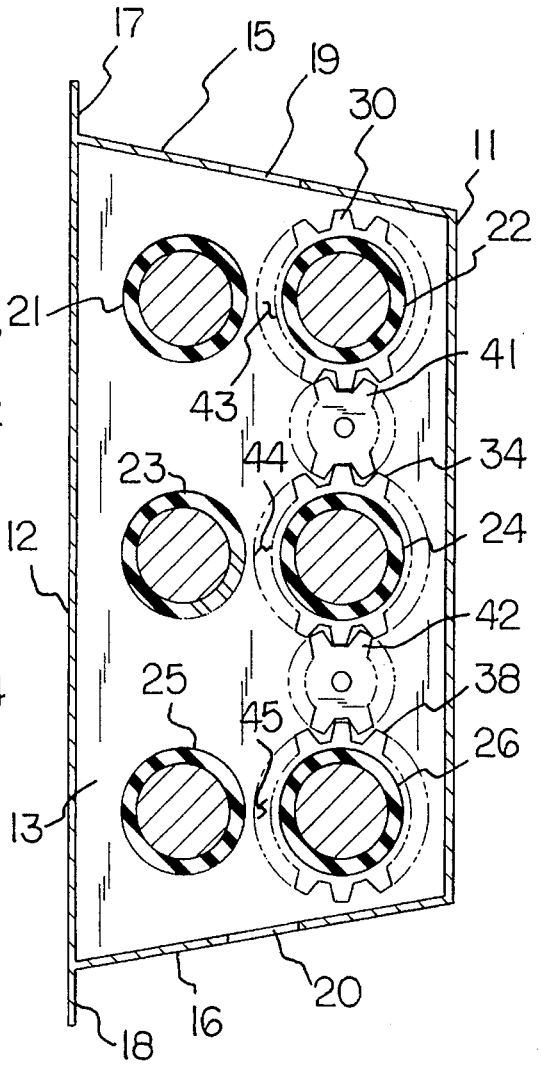
FIG. 5 is a cross-sectional view, taken along the lines 5—5 as indicated in FIG. 2.

The first roller 21 includes a first roller first gear 27 at a first end of the first roller, with the second roller having a second roller first gear 29 at a first end of the second roller, and a second roller second gear 30 at a second end of the second roller. The third roller having a third roller first gear 31 at a first end of the third roller, the fourth roller 24 having a fourth roller first gear 33 at a first end of the fourth roller, and a fourth roller second gear 34 at a second end of the fourth roller. The fifth roller 25 having a fifth roller first gear 35 at a first end of the fifth roller, with the sixth roller 26 having a sixth roller first gear 37 at a first end of the sixth roller, and a sixth roller second gear 38 at a second end of the sixth roller. It should be noted, such as illustrated in FIG. 4, that the first roller first gear 27 cooperates with the second roller first gear 29, the third roller first gear 31 cooperates with the fourth roller first gear 33, and the fifth roller first gear 35 cooperates with the sixth roller first gear 37. The second, fourth, and sixth rollers 22, 24, and 26 respectively are in rotative cooperation relative to one another through intermediate gears, such that a first intermediate gear 41 is arranged to engage the second roller second gear 30 and the fourth roller second gear 34, with a second intermediate gear 42 engaging the second roller second gear 34 and the sixth roller second gear 38. A drive shaft 39 is integral to and secured to the fourth roller 24 and coaxially aligned with the fourth roller axle, a handle 40 secured to the drive shaft 39 effects rotation of the fourth gear, which in turn effects rotation of the second and sixth gears. As the second, fourth, and sixth rollers rotate, they in their geared engagement with the respective first, third, and fifth rollers 21, 23, and 25 respectively direct rotation of those rollers to thereby have positive rotation of each of the rollers of each roller pair. As indicated in FIG. 3, at least a row of drain openings 46 are directed through the bottom wall 16 in adjacency to the rear wall, as the bottom wall 16 is canted from the rear wall upwardly to the front wall and thereby water may accumulate at the intersection of the bottom wall and rear wall for drainage through the openings 46.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. A car mat presser device, comprising, a housing, the housing having a front wall spaced from a rear wall, a first side wall spaced from a second side wall, a top wall spaced from a bottom wall, and the top wall having an entrance slot and the bottom wall having an exit slot, with the entrance slot and the exit slot arranged in an aligned coextensive relationship relative to one another, and a plurality of roller pairs to include at least a first roller pair and a second roller pair contained within the housing and extending between the first side wall and the second side wall, the first roller pair having a first nip and the second roller pair having a second nip, the first nip, the second nip, and the entrance slot, and the exit slot are arranged in an aligned relationship relative to one another, the bottom wall intersecting the rear wall, and the bottom wall being canted from the rear wall upwardly to the front wall, the bottom wall having at least one drainage opening adjacent the intersection of the bottom wall and the rear wall.

2. A device as set forth in claim 1 wherein the first roller pair includes a first roller and a second roller arranged in a parallel coextensive relationship, and the second roller pair defined by a third roller and a fourth roller arranged in an aligned coextensive relationship, with the fourth roller further having a drive shaft extending therefrom integral with and coaxially aligned relative to the fourth roller, and the drive shaft extending through the second side wall, with the drive shaft arranged for rotation to effect rotation of the first roller pair and the second roller pair.

3. A device as set forth in claim 2 wherein the first roller includes a first gear at a first end of the first roller, and the second roller having a second roller first gear at a first end of the second roller in cooperative engagement with the first roller first gear, the second roller having a second roller second gear at a second end of the second roller, and the third roller having a third roller first gear at a first end of the third roller, and the fourth roller having a fourth roller first gear at a first end of the fourth roller in cooperative engagement with the third roller first gear, the fourth roller having a fourth roller second gear at a second end of the fourth roller, and the second roller second gear and the fourth roller second gear further including an intermediate gear cooperating therebetween, such that rotation of the fourth roller translates to rotation of the second roller through the intermediate gear.

4. A device as set forth in claim 3 including a third roller pair, the third roller pair defining a third nip therebetween, wherein the third nip is aligned with and coextensive to the first nip and the second nip, and the third roller pair having a fifth roller and a sixth roller rotatably mounted between the first side wall and the second side wall, with the fifth roller having a fifth roller first gear at a first end of the fifth roller, and the sixth roller having a sixth roller first gear at a first end of the sixth roller in cooperative engagement with the fifth roller first gear, and the sixth roller having a sixth roller second gear at a second end of the sixth roller, and a further intermediate gear arranged in operative engagement between the sixth roller second gear and the fourth roller second gear.

* * * * *